US005419523A

United States Patent [19]

Alpert et al.

[11] Patent Number: 5,419,523

[45] Date of Patent: May 30, 1995

[54] ROLL SUPPORT HANGER

[75] Inventors: Andrew J. Alpert; Stephen S. Alpert, both of Wayland, Mass.; Douglas P. Duprey, Ocean, N.J.

[73] Assignee: Royal Engineering Company, Trenton, N.J.

[21] Appl. No.: 158,608

[22] Filed: Nov. 29, 1993

[51] Int. Cl.[6] ..... F16M 13/00

[52] U.S. Cl. ..... 248/301; 248/341; 248/201; 211/121

[58] Field of Search ..... 248/309.1, 304, 201, 248/341, 202.1, 309.2, 231.9, 224.3, 221.3, 222.1, 225.1, 644, 659, 200.1, 307, 301; 211/121; 160/265

[56] References Cited

U.S. PATENT DOCUMENTS

| | | | |
|---|---|---|---|
| 581,049 | 4/1897 | Unkenholz | 211/121 |
| 704,157 | 7/1902 | White | 211/121 |
| 887,282 | 5/1908 | Smith | 211/121 |
| 918,937 | 4/1909 | Wilmore | 211/121 |
| 1,787,898 | 1/1931 | Fuller | 211/121 |
| 1,797,032 | 3/1931 | Wendel | 211/121 |
| 1,894,166 | 1/1933 | Elliot | 211/121 |
| 1,959,926 | 5/1934 | Reich | 211/121 X |
| 2,442,070 | 5/1948 | Bouchard | 211/121 X |
| 2,710,240 | 6/1955 | Berg | 211/121 |
| 3,618,176 | 11/1971 | Barnes | 248/301 X |
| 3,861,519 | 1/1975 | Ware | 211/121 |
| 3,923,278 | 12/1975 | Marcil | 248/301 |
| 4,911,394 | 3/1990 | Ericson | 248/301 X |
| 5,092,730 | 3/1992 | Neri | 211/121 |

FOREIGN PATENT DOCUMENTS

| | | | |
|---|---|---|---|
| 5294414 | 11/1993 | Japan | 211/121 |

OTHER PUBLICATIONS

INTERTEX drawing (Inventor and date unknown).

ASIA AMERICA drawing (Inventor and date unknown).

*Primary Examiner*—Karen J. Chotkowski

*Attorney, Agent, or Firm*—Martin Fruitman

[57] ABSTRACT

The apparatus is a hanger for the ends of the axle of a roll of sheet goods such as carpeting. The hanger is a short "U" channel with a spindle attached across the top of the "U" and protruding out from one side. The spindle is used to substitute for the pin between links of vertical endless chains which hold multiple rolls for display. The side of the "U" opposite from the protruding spindle has a slot which curves down from a vertical edge of the side toward the bottom of the "U". A spring loaded catch pivots across the slot, but only moves in the direction which permits the end of a roller axle to enter the slot while preventing the axle from lifting out from the slot.

6 Claims, 2 Drawing Sheets

ROLL SUPPORT HANGER

SUMMARY OF THE INVENTION

This invention deals generally with supports and racks, and more specifically with a roller support hanger for an endless carrier.

Vertically oriented endless carriers are a convenient and common apparatus for displaying and marketing roll goods such as carpeting. It is both difficult and dangerous for either sales clerks or customers to move around heavy rolls of carpeting, so vertically stacked horizontal rolls on a motorized display rack permit many of such heavy rolls to be simultaneously stored and displayed in limited floor space. Furthermore, cutting apparatus can be associated with such racks, so that, once a particular carpet is selected, the required quantity can immediately be cut from the roll and sold.

Such display racks are constructed with two parallel, vertical endless chain carriers spaced apart by slightly more than the width of the rolled goods displayed. The chains move around gears located at the top and the bottom of the rack, and the chains are driven from a common shaft, so that they move together and always maintain the rolls of goods in a horizontal orientation. As the endless chains move either up or down, different rolls of goods are moved in front of the customer, while other rolls are located above, below, and in a second stack of rolls behind the stack in front, which is visible to the customer. Long rods which span the distance between the chain carriers are used as axles within hollow cores upon which the goods are rolled, and the axles are hung from pivoting support hangers which are attached to the chain carriers.

The support hangers allow the rolls to hang somewhat below the hanger pivot point, so that, ideally, the rolls do not rotate when the chain carriers reverse their direction of movement at the top and bottom of the display rack. Also, since it is occasionally necessary to replace the rolls, the hangers must include some provision for accepting and releasing an end of the roll axis. Furthermore, since the rolls are so heavy, it is desirable to include some means to lock the end of the axle into the hanger.

To accomplish these goals, the typical hanger is constructed with a plate attached to a rod spindle which is perpendicular to the plate, and the hanger is attached to the chain by using the spindle to replace a pivot rod on the chain. The plate includes a straight slot which accepts the end of the roll axle, and a spring loaded lever which is used to permit the axle to move into the slot, but to prevent accidental movement out of the slot without independently moving the lever.

Several problems have, however, arisen with these hangers. One problem is that with a single plate holding the axle, it is possible for the axle to move against the chain and interfere with the chain's movement. Other problems result from the configuration of the slot which holds the axle. If the slot is not long enough, the roll is located too close to the pivot point of the hanger, and, if the spindle binds within the chain to some degree, the roll may attempt to turn over as the chain moves over the upper or lower gears. Under these circumstances of high stress, it is possible for the roll axle to separate from the hanger and the roll may break loose at one end. A loose roll on a moving carrier is clearly a dangerous situation.

Another problem with the slot occurs when the roll is first loaded into the hanger. Although, because of the weight of the roll, this must always be done with at least two people handling the roll, inserting the end of the axle into the hanger is still quite difficult. Because the installed axle should be below the spindle, all prior art slots have been oriented somewhat vertically. Typically, such slots have been located so that they are open to the top horizontal surface of the hanger plate and are oriented vertically straight down. Another type slot opens at the front vertical surface of the plate and slants straight down at approximately a 45 degree angle.

Neither of these designs are completely satisfactory. The slots with entry at the top edge of the plate are difficult to load with the roll axle, and the slots angled at 45 degrees are shorter, and the angle makes it much easier for a slight tilt of the hanger to permit the axle to jump out of the slot.

The present invention is a roll hanger which overcomes all of the problems of the previous hangers. It includes a curved, rather than a straight, slot, and the slot is front loading, but is shaped so that the roll axis must actually be lifted up and moved forward out of the slot to be released. The roll hanger of the invention also includes two parallel plates, both attached to the spindle, to yield a much stronger hanger which also protects the chain from interference from the roll axle. The invention also uses a prescribed minimum distance for the bottom of the slot to be below the spindle. This distance is selected to assure that the weight of any roll, even a near empty one, provides sufficient torque at the prescribed minimum distance to assure that the roll axle always remains below the spindle.

The present invention thereby provides a roll hanger which is easy to load and unload and safe to use, because it prevents the roll axle from ever jumping out of the hanger.

DETAILED DESCRIPTION OF THE INVENTION

Figure 1:
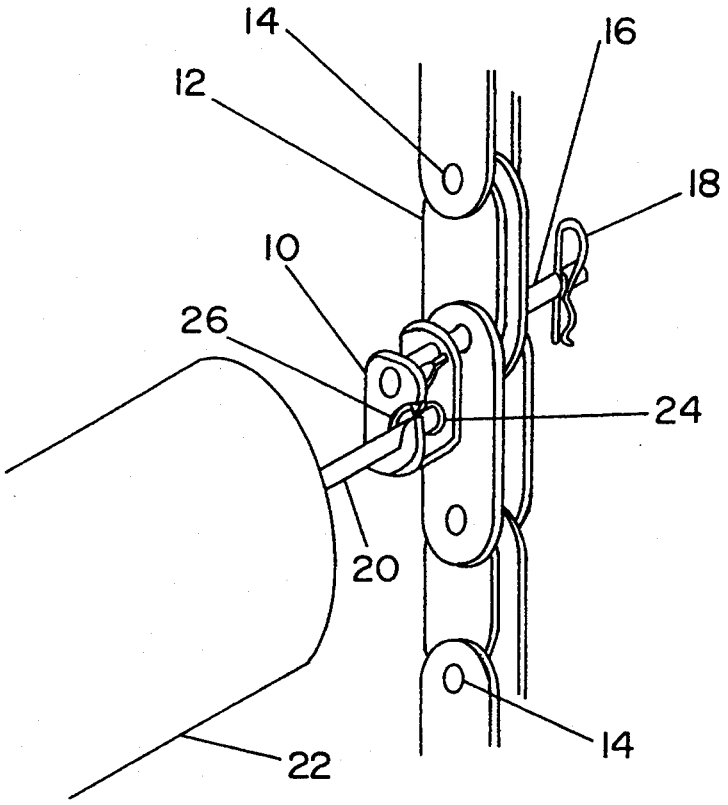
FIG. 1 is a perspective view of the preferred embodiment of the invention installed upon an endless chain.

FIG. 1 is a perspective view of the preferred embodiment of the invention installed for use, in which roll hanger 10 is inserted into endless chain 12 by replacing one of the pivot pins 14 of chain 12 with spindle 16 of roll hanger 10. Spring clip 18 is used to prevent spindle 16 from moving axially out of chain 12.

Roll hanger 10 functions as a support for one end of axle 20 of roll 22. The other end of axle 20 is held by a similar roll hanger on another parallel endless chain (not shown), so that roll 22 can be moved up and down in a vertical plane while axle 20 remains horizontal. Axle 20 can be provided with an end cap 24 to aid in preventing axle 20 from pulling out of slot 26 of hanger 10.

Figure 2:
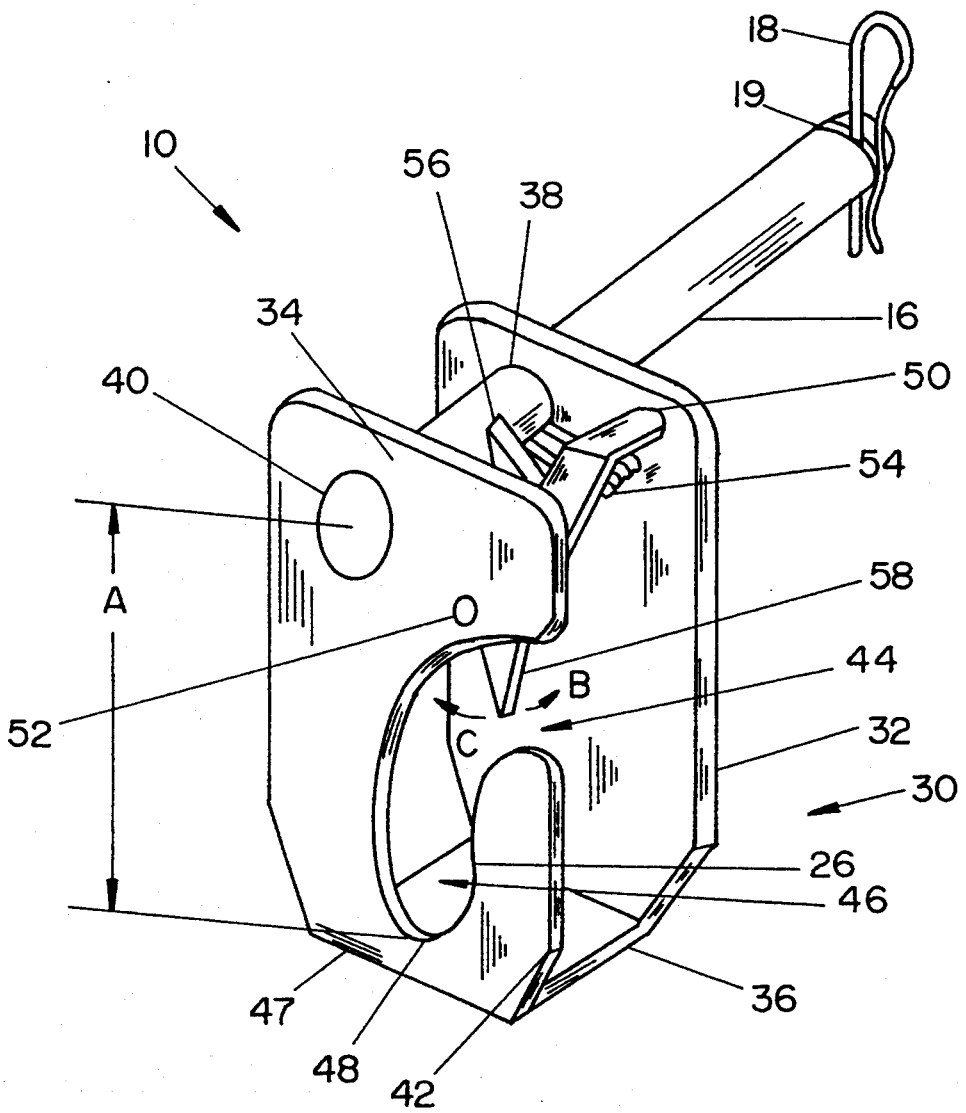
FIG. 2 is a perspective view of invention showing the details of construction of the preferred embodiment.

FIG. 2 is a perspective view of the preferred embodiment of hanger 10 showing the details of its construction. Hanger 10 is constructed from "U" section 30 which has two sides, 32 and 34, joined by web 36 at their lower parallel edges. Sides 32 and 34 are both attached, typically by welding, to spindle 16 which penetrates and fills holes 38 and 40 in sides 32 and 34, respectively. Spindle 16 is oriented perpendicular to sides 32 and 34. The rigid support furnished across the top of "U" section 30 by spindle 16 provides a very strong structure for the support of roll axle 20 (FIG. 1) when roll hanger 10 is inserted into chain 12.

Spindle 16 protrudes from the side of plate 32 which is remote from plate 34 and can be inserted into a chain to replace the chain's pivot pin. Spring clip 18 is attached to the end of spindle 16 by insertion into hole 19 so that spring clip 18 prevents spindle 16 from being withdrawn from the pivot pin hole of the chain into which it is placed.

The most obvious structural feature of inboard side 34 of "U" section 30 is curved slot 26. Slot 26 begins at vertical edge 42 of side 34 with entrance section 44 which is transverse to edge 42, and ends with end section 46 which is transverse to edge 47 of plate 34 near web 36. The inclusion of entrance section 44 permits the roll axle to be placed into slot 26 from more accessible front edge 42, while near vertical end section 46 takes full advantage of the weight of roll 22 (FIG. 1) to hold axle 20 (FIG. 1) in place within slot 26.

A more subtle feature of hanger 10 is the value selected for dimension A, the distance from the axis of spindle 16 to boundary edge 48 of slot 26 near web 36. For satisfactory operation, dimension A must be at least 1.5 inches. Such a minimum distance between spindle 16 and the point of application of the weight of a roll being supported by hanger 10 provides sufficient torque, as the endless chains reverse direction at their highest and lowest points of travel, to assure that friction between spindle 16 and chain 12 will not cause hanger 10 to turn over and cause the misalignment of a roll, interference between rolls, or even separation of the roll axle from slot 26.

Lever 50 is another feature of hanger 10 which aids in keeping the roll axle within slot 26. Lever 50 pivots on pin 52 and is held in the position shown in FIG. 2 by coil spring 54. In the position of lever 50 shown in FIG. 2, stop 56, which is attached to lever 50 prevents catch 58, a part of lever 50, from moving in direction B.

Since catch 58 blocks blocks entrance 44 of slot 26, it prevents an axle located within slot 26 from slipping out through entrance 44. However, movement of catch 58 in direction C, although resisted by spring 54 attached to lever 50, is not prevented. Therefore an axle can easily be slid into slot 26 and past catch 58 without any manipulation of lever 50. Once the axle is in slot 26, it can then only be removed by first pulling lever 50, so that catch 58 moves in direction C, across and clear of slot 26. It is then possible to slide the axle out of slot entrance 44 while still holding lever 50. When lever 50 is then released, it returns to the position shown, ready for insertion of another axle.

The invention thereby furnishes a convenient and safe roll hanger with superior strength, which easily permits desirable access of a roll axle into the hanger, but prevents accidental separation of the axle from the hanger.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, spindle 16 may be made longer or shorter than shown and could be held in place by capture means other than spring clip 18. Moreover, lever 50, catch 58, and stop 46 may be combined in a different configuration, or a different type of spring 54 could be used.

What is claimed as new and for which Letters patent of the United States are desired to be secured is:

1. A roll hanger for holding an end of a roll axle on an endless chain comprising:

a first planar plate with a thickness, a first edge, and a second edge transverse to the first edge, and also including a slot through the thickness of the first plate, the slot including a first section with sides which are traverse to the second edge and an opening at the second edge, and the slot curving from the second edge toward the first edge, with an end boundary of the slot in a second section of the slot having sides which are oriented transverse to the first edge;

a second planar plate parallel to and adjacent to the first plate and attached to the first plate by a connector plate attached to the first edge of the first plate and to a first edge of the second plate which is parallel to and adjacent to the first edge of the first plate; and a spindle comprising a rod, the spindle attached to the first plate at a location on the first plate on the far side of the slot from the first edge of the first plate, with the spindle also attached to the second plate, oriented perpendicular to the plane of the second plate and protruding from the second plate on the side of the second plate remote from the first plate.

2. The roll hanger of claim 1 further including a locking means attached to the spindle to prevent the spindle for being removed form a hole through which the spindle is placed.

3. The roll hanger of claim 1 further including a spring clip attached to the spindle to prevent the spindle for being removed form a hole through which the spindle is placed.

4. The roll hanger of claim 1 further including slot blocking means adjacent to the first plate and blocking a rod placed within the slot from moving from the second section of the slot to the opening of the slot.

5. The roll hanger of claim 1 further including a slot blocking means which comprises a pivoted and spring loaded lever including a blocking end which is held across the first section of the slot and can pivot clear of the slot until it no longer blocks the slot, but is stopped from pivoting toward the opening of the slot.

6. The roll hanger of claim 1 wherein the end boundary of the slot in the first plate is spaced from the spindle axis by at least 1.5 inches.

* * * * *